United States Patent [19]

Eheim

[11] 4,426,969

[45] Jan. 24, 1984

[54] OVERSPEED SAFETY MEANS FOR FUEL INJECTION PUMPS OF INTERNAL COMBUSTION ENGINES

[75] Inventor: Franz Eheim, Stuttgart, Fed. Rep. of Germany

[73] Assignee: Robert Bosch GmbH, Stuttgart, Fed. Rep. of Germany

[21] Appl. No.: 380,377

[22] Filed: May 20, 1982

[30] Foreign Application Priority Data

Jun. 4, 1981 [DE] Fed. Rep. of Germany ..... 3122250

[51] Int. Cl.[3] ..... F02D 5/00

[52] U.S. Cl. ..... 123/357; 123/458; 123/198 DB; 417/289

[58] Field of Search ..... 123/357, 359, 458, 198 DB, 123/333, 351; 200/80 R; 417/505, 289

[56] References Cited

U.S. PATENT DOCUMENTS 595,324 12/1897 MacFadden ..... 123/198 DB
3,661,130 5/1972 Eheim ..... 123/358
4,073,275 2/1978 Hofer et al. ..... 123/449
4,083,346 4/1978 Eheim ..... 123/198 DB
4,315,118 2/1982 Kramer et al. ..... 200/80 R

FOREIGN PATENT DOCUMENTS 1940738 3/1971 Fed. Rep. of Germany ..... 123/357

*Primary Examiner*—Ira S. Lazarus
*Assistant Examiner*—Magdalen Moy
*Attorney, Agent, or Firm*—Edwin E. Greigg

[57] ABSTRACT

An overspeed safety means for fuel injection pumps of internal combustion engines in which an electrically actuatable valve is retained by an electromagnet provided in an electrical circuit in an open, retracted position which assures the normal operation of the engine or of the fuel injection pump. The electrical circuit includes a destructable loop which is located adjacent to a device deflectable in response to centrifugal force; when this device is deflected into a position corresponding to a specific threshold rpm, it severs the loop in the circuit, thus closing the valve and terminating injection.

4 Claims, 1 Drawing Figure

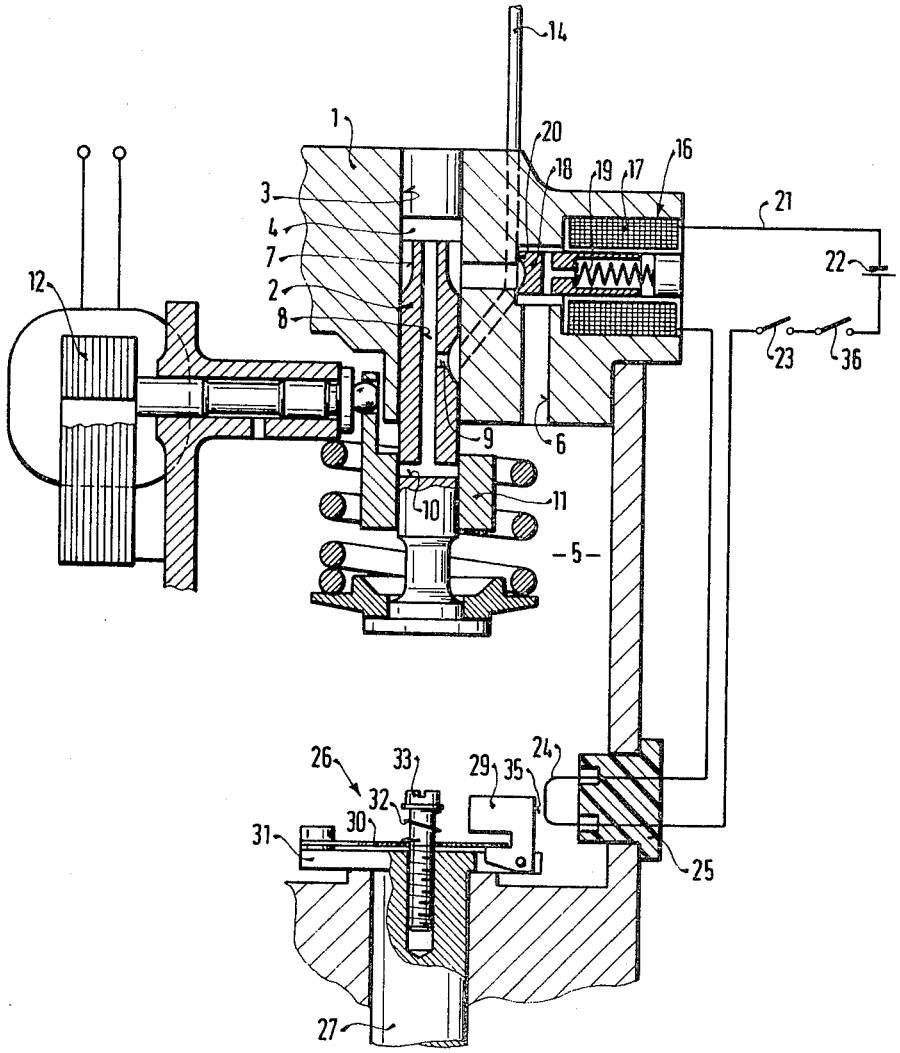
14
1
20
18
19
17
16
21
3
4
7
2
8
12
22
23
36
9
6
10
11
-5-
26
33
29
35
24
32
30
31
25
27

OVERSPEED SAFETY MEANS FOR FUEL INJECTION PUMPS OF INTERNAL COMBUSTION ENGINES

BACKGROUND OF THE INVENTION

The invention is directed to an overspeed safety means for fuel injection pumps of internal combustion engines having a valve closable upon interruption of an electrical circuit to shut off fuel. It is known to limit the rpm in Diesel engines by using a mechanical centrifugal governors in combination with injection pumps. If the control element of such a centrifugal governor exceeds a predetermined amount of deflection, the delivery of fuel by the fuel injection pump is thereby affected.

Especially with Diesel engines where the fuel injection quantity is regulated electronically, the problem of overspeed safety occurs. Either the already known mechanical overspeed safety means have to be used together with the electronic regulating units, or else specialized electronic overspeed safety means have to be created which function just as safely and reliably as the mechanical governors used heretofore.

In known overspeed safety means an rpm transducer is provided which emits an rpm-dependent voltage which, amplified by an amplifier circuit, controls a relay in the current circuit of the valve. Even the starting rpm of the engine is sufficient to obtain a volage at the output of the amplifier by means of which the relay is put into its closing position. Upon attaining a threshold rpm or a maximum permissible voltage at the input of the amplifier, a safety means in the input of the amplifier is actuated so that the amplifier is switched off and the relay is opened. This apparatus is quite expensive, however, and it includes sources of possible malfunction which can affect the reliability of the apparatus. Additional fail-safe provisions then have to be made, such as second shutoff safety means at the input of the amplifier.

An electrical centrifugal switch is also known, having a flyweight which deflects under the influence of centrifugal force; when the flyweight is in a specific deflected position, a switching contact can thereby be lifted, so that the supply of current to an electrically controlled fuel injection system is shut off. This apparatus has the disadvantage, however, that particularly when the contacts are not fully actuated at engine operating states near the threshold rpm range, the contacts can freeze or become soiled, thus no longer assuring the supply of current for an operating range which is in fact permissible. Even if the contact pairs are still functional, the current circuit can be closed again immediately after it has been interrupted, for instance because of the decreasing rpm caused by the failure of the fuel supply. Thus it becomes possible for the engine to be driven impermissibly in a harmful, high rpm range for a relatively long period. The continual switchovers occuring near this threshold range also damage the contacts as mentioned above. In particular, this type of safety means does not provide the operator of the engine with an opportunity to locate the source of the trouble causing the overspeeding.

OBJECT AND SUMMARY OF THE INVENTION

It is the object of the fuel injection pump according to the invention to provide the advantage over the prior art that upon attaining excess rpm, the current circuit of the electrically actuatable valve is interrupted completely, and operation of the engine can be resumed only after the cause of the malfunction has been eliminated; yet in other operating ranges, uninterrupted operation is assured.

The invention will be better understood and further objects and advantages thereof will become more apparent from the ensuing detailed description of a preferred embodiment taken in conjunction with the drawing.

BRIEF DESCRIPTION OF THE DRAWING

The single FIGURE of the drawing shows an exemplary embodiment of the invention which is described in greater detail below.

DESCRIPTION OF THE PREFERRED EMBODIMENT

In the drawing, a portion of a distributor-type injection pump is shown schematically, in the housing 1 of which a pump piston 2 is disposed which simultaneously reciprocates and rotates; the pump piston simultaneously acts as a distributor and encloses a work chamber 4 within a cylinder 3 of the housing.

The supply of fuel to the pump work chamber 4 is effected from a suction chamber 5 via an intake conduit 6, the mouth of which extending into the pump work chamber is opened during the intake stroke of the pump piston by means of longitudinal grooves 7 on the pump piston. Extending within the pump piston is a longitudinal conduit 8, from which a radial distributor bore 9 and a second radial distributor bore 10 branch off; their outlet at the pump piston into the suction chamber 5 is controlled by an annular slide 11. Depending upon the fuel injection quantity to be supplied, the annular slide 1 assumes a higher or lower position, controlled by a rotary electro-magnet 12, which receives its adjustment signals from an electronic control unit, not shown in further detail. Depending upon the stroke position of the annular slide 11, the radial bore 10 is opened up earlier or later during the supply stroke of the pump piston. The opening of this bore 10 interrupts the injection process, and the remaining supplied fuel is capable of flowing out into the suction chamber. So long as the radial bore 10 is closed during the supply stroke of the pump piston, the fuel is delivered from the suction chamber via the longitudinal conduit 8 and the distributor bore 10 into one of a plurality of injection lines 14 disposed at the circumference of the pump piston.

An electrically actuatable valve 16 is disposed in the intake conduit 6 and is provided with a magnetic winding 17 and a movable armature 18 comprising the valve closing member. The armature 18 is continuously stressed by a spring 19 and urged thereby against a valve seat 20, which is located in the passageway cross section of the intake conduit 6. Upon excitation of the magnetic winding, the armature 18 is lifted from the valve seat 20 counter to the force of the spring 19, and the cross section of the intake conduit 6 is opened up. The magnetic winding 17 is provided with a current supply circuit 21, in which a current source 22 and a switch 23 are connected in series. A current loop 24 embedded in a socket 25 is also provided in the current circuit. The socket 25 comprises an insulating body and preferably has a releasable connection with the current supply circuit 21.

For driving the pump piston, the fuel injection pump has a drive shaft which also drives a centrifugal switching element 26. The centrifugal switching element comprises a rotating shaft 27, which may be part of the drive shaft or may be driven separately by the drive shaft, and has at least one flyweight 29, which is firmly connected with the shaft 27. A spring 30 acts upon the flyweight, keeping it in an outset position. The spring 30 may be a leaf spring secured on a flange 31 of the rotating shaft, the flange protruding into the suction chamber 5, and the action of the leaf spring may be further reinforced by a helical spring 32. The helical spring may be retained for example, by means of a screw 33 threaded coaxially into the shaft and passing through the leaf spring 30; the helical spring 32 is then stretched between the screw head and the leaf spring. The flyweight is provided with a knife edge 35, which upon the deflection of the flyweight counter to the restoring force of the spring 30 or 32 can come into contact with the loop 24 which also protrudes into the suction chamber 5.

The described centrifugal switch can naturally also be attached to areas of the fuel injection pump which do not contain fuel; however, because the current loop 24 carries current openly, it is then preferable that chambers which are sealed off from the outside be used for such a purpose.

The described apparatus functions as follows:

When the engine is put into operation, for instance via the ignition switch, the current circuit 21 is closed by the switch 23; the magnet is excited, and the intake conduit 6 is opened. Until the attainment of the maximum permissible rpm, the armature 18 remains in the open, retracted position, and the flyweight 29 remains in a position in which it does not come into contact with the current loop 24. Upon attaining the threshold rpm, the knife edge 35 then severs through the loop 24, so that the current circuit is interrupted totally and completely. At the same time, the electro-magnetic valve 12 moves to a position of close, so that the work chamber 4 of the fuel injection pump can no longer be supplied with fuel, and injection by the fuel injection pump is terminated.

For a resumption of operation of the fuel injection pump, the socket 25 having the loop 24 must be replaced. Because a repair is necessitated, an impetus is thus also provided for seeking the reasons in the engine as to why the threshold rpm was exceeded and then correcting the defect as needed.

In order to provide emergency shutoff means, it is also possible to include a manually-actuated switch 36 in the current circuit 21, either alternatively or in addition to the above embodiment, by means of which the operator of the engine is able to interrupt the fuel supply to the engine under any chosen circumstances.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An overspeed safety apparatus for a fuel injection pump provided on an internal combustion engine, said injection pump having a work chamber and a suction chamber, said work chamber communicating with said suction chamber via an electrically activated valve, said electrically activated valve being operated by an electrical circuit and normally being held in an open position during operation of said engine, said pump further having means for ascertaining a threshold rpm for fuel shut-off and thereupon permanently interrupting the electrical circuit to close the electrically activated valve, characterized in that said means for ascertaining the threshold rpm comprises a centrifugal, electrical conductor, interruptor means provided with a flyweight, said flyweight pivoting counter to means providing a restoring force in proportion to increasing rpm in response to centrifugal force, said electrical circuit having an electrical conductor loop means positioned adjacent to said centrifugal, electrical conductor, interruptor means, said electrical conductor loop means being severed by said flyweight upon said centrifugal electrical conductor, interruptor means attaining the threshold rpm, thereby permanently interrupting said electrical circuit thereby closing said electrically activated valve to prevent fuel flow from the suction chamber to the work chamber whereby said electrical conductor loop means must be replaced in order to complete the electrical circuit to said electrically activated valve.

2. An overspeed safety apparatus as defined by claim 1, further characterized in that the flyweight includes a knifelike edge for severing the electrical conductor loop means.

3. An overspeed safety apparatus as defined by claim 2, further characterized in that the electrical conductor loop means is disposed in a replaceable insert.

4. An overspeed safety apparatus as defined by claim 1, characterized in that an arbitrarily actuatable electrical switch is disposed in the electrical circuit.

* * * * *